US005320359A

United States Patent [19]

Harwell et al.

[11] Patent Number: 5,320,359

[45] Date of Patent: Jun. 14, 1994

[54] FOAM DART AND SHIELD COMBINATION

[75] Inventors: Sam K. Harwell; Thomas J. O'Rourke, both of Nashville, Tenn.

[73] Assignee: Kidpower, Inc., Brentwood, Tenn.

[21] Appl. No.: 102,060

[22] Filed: Aug. 4, 1993

[51] Int. Cl.[5] ..... A63B 67/00

[52] U.S. Cl. ..... 273/346; 273/412; 273/416; 273/DIG. 30

[58] Field of Search ..... 273/346, 344, 345, 347, 273/412, 416, DIG. 30, DIG. 25

[56] References Cited

U.S. PATENT DOCUMENTS

| | | | |
|---|---|---|---|
| 3,032,345 | 5/1962 | Lemelson | 273/346 |
| 3,857,566 | 12/1974 | Lemelson et al. | 273/346 |
| 4,017,076 | 4/1977 | Bai | 273/346 |
| 4,057,251 | 11/1977 | Jones et al. | 273/346 |
| 4,971,334 | 11/1990 | Stewart | 273/346 |
| 4,986,548 | 1/1991 | Conner | 273/346 |
| 4,995,617 | 2/1991 | Lee | 273/346 |
| 5,066,017 | 11/1991 | Kurland | 273/344 |
| 5,080,374 | 1/1992 | Yu | 273/346 |
| 5,085,442 | 2/1992 | Lee | 273/346 |
| 5,102,146 | 4/1992 | Kurland | 273/412 |
| 5,123,655 | 6/1992 | Rones | 273/346 |
| 5,139,273 | 8/1992 | Rudell et al. | 273/346 |

*Primary Examiner*—William H. Grieb

*Attorney, Agent, or Firm*—Wood, Phillips, VanSanten, Hoffman & Ertel

[57] ABSTRACT

A novel recreational game includes in combination a shield and a dart both including one-half of a structure for retaining the dart on the shield when the dart is thrown towards the shield. The dart is provided with an enlarged front head with an impact surface. The enlarged front head is weighted relative to the rest of the dart so that regardless of how it is thrown, the impact surface is in position to contact the shield when thrown towards the shield.

18 Claims, 4 Drawing Sheets

50

10
12
12
10

FOAM DART AND SHIELD COMBINATION

FIELD OF THE INVENTION

This invention relates to recreational games, and more specifically, to a recreational game including in combination shields and darts.

BACKGROUND OF THE INVENTION

With the introduction of Velcro® hook and pad fasteners, a number of games involving projectiles and targets have been created. (Velcro® is a registered trademark of Velcro Industries B.V. of Holland.)

In some of these inventions, the object of the game is for one person to throw a projectile consisting of a ball with Velcro® fasteners and the other participant to catch the thrown ball either by means of Velcro® pad fasteners on their body or a Velcro® pad target held in the hand.

Other games have been developed wherein the Velcro® fastening system is not used because of the projectile being thrown. When the projectile is of a nonuniform nature, the only way the Velcro® fastening system can be used to capture the projectile on the Velcro® pad fastener on the body or target is if the projectile is substantially covered with the Velcro® fastener.

Particularly, when the projectile is in the form of a dart, the Velcro® pad fastening system has heretofore not been used. Instead, the projectile in the shape of a dart has been provided with a suction cup extending from one end of the body. The suction cup is designed to be captured on the receiving surface of a second participant's shield when the first participant throws the projectile towards the second participant. The use of a suction cup presents problems with respect to aerodynamics of the dart and capture of the dart on the shield.

Still other inventions where Velcro® fasteners have been used include target games. In particular, these games use a target employing a hooking material defining a target surface adapted to removably retain a plurality of missiles or darts thereagainst by hooking engagement with filamentary formations protruding from the missile.

SUMMARY OF THE INVENTION

Accordingly, one aspect of the invention is to provide a novel recreational game.

Another aspect of this invention is to provide a novel recreational game including in combination a shield and a dart both including one-half of a structure for retaining the dart on the shield when the dart is thrown towards the shield. The dart is provided with an enlarged front head with an impact surface. The enlarged front head is weighted relative to the rest of the dart so that regardless of how it is thrown, the impact surface is in position to contact the shield when thrown towards the shield.

Preferably, the dart has a plurality of spaced wings to provide the dart with an airfoil to control stability for improved flight regardless of how it is thrown. In another preferred form, the dart head is grooved to further improve the flight of the dart.

Still another aspect of this invention is to make the dart from a foam material.

Another aspect of the invention is to provide the shield with a front wall and a rear wall including a plurality of interconnected planes which form a vaulted surface.

Yet another aspect of this invention is the provision of one-half of the fastening system on the front face of the front wall with the front of the wall further including a retainer section with notches to removably retain the darts therein.

Still another aspect of this invention is to provide the rear wall with a structure for holding the shield.

In a preferred form, the fastening system used is a Velcro® system with the impact surface of the dart having a multitude of broken loops of filament thereon and the front wall of the shield likewise circumscribing a multitude of tiny wire-like filaments shaped into loops capable of capturing the impact surface of the dart.

DETAILED DESCRIPTION

Figures 1, 2, 3:
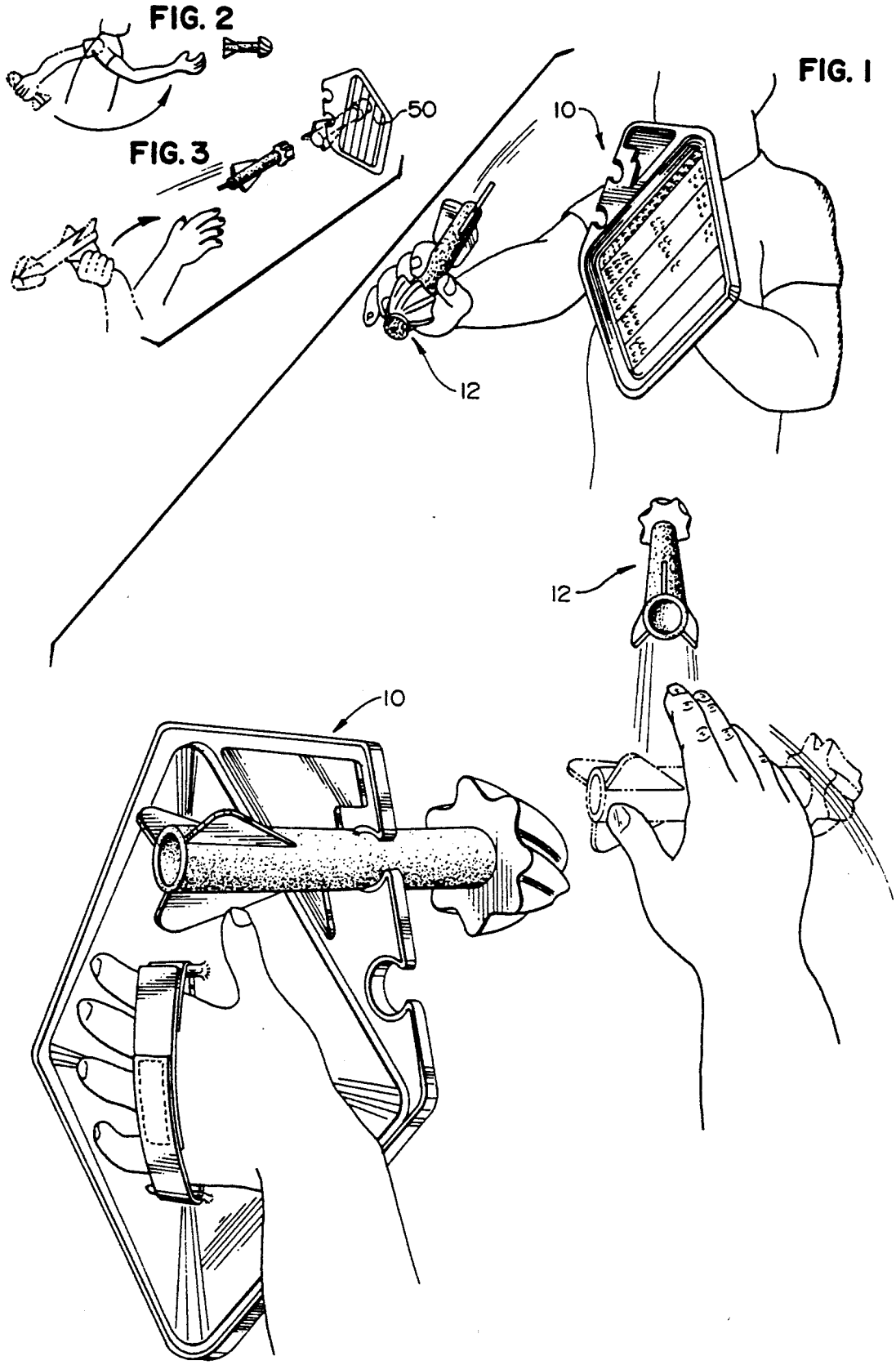
FIG. 1 illustrates use of the game by two participants.
FIG. 2 illustrates launching of the dart with an underhand release.
FIG. 3 illustrates an overhand launch of the dart.

FIG. 1 shows use of the recreational game of the present invention by two participants. The game includes shields 10 held by the players and darts 12 thrown and caught by the players. The darts 12 are uniquely designed so that the dart can be gripped in any manner and thrown from any position with any trajectory towards the shield (see FIGS. 1-3) and still be captured by a fastening system 50 more fully described herein.

Figure 4:
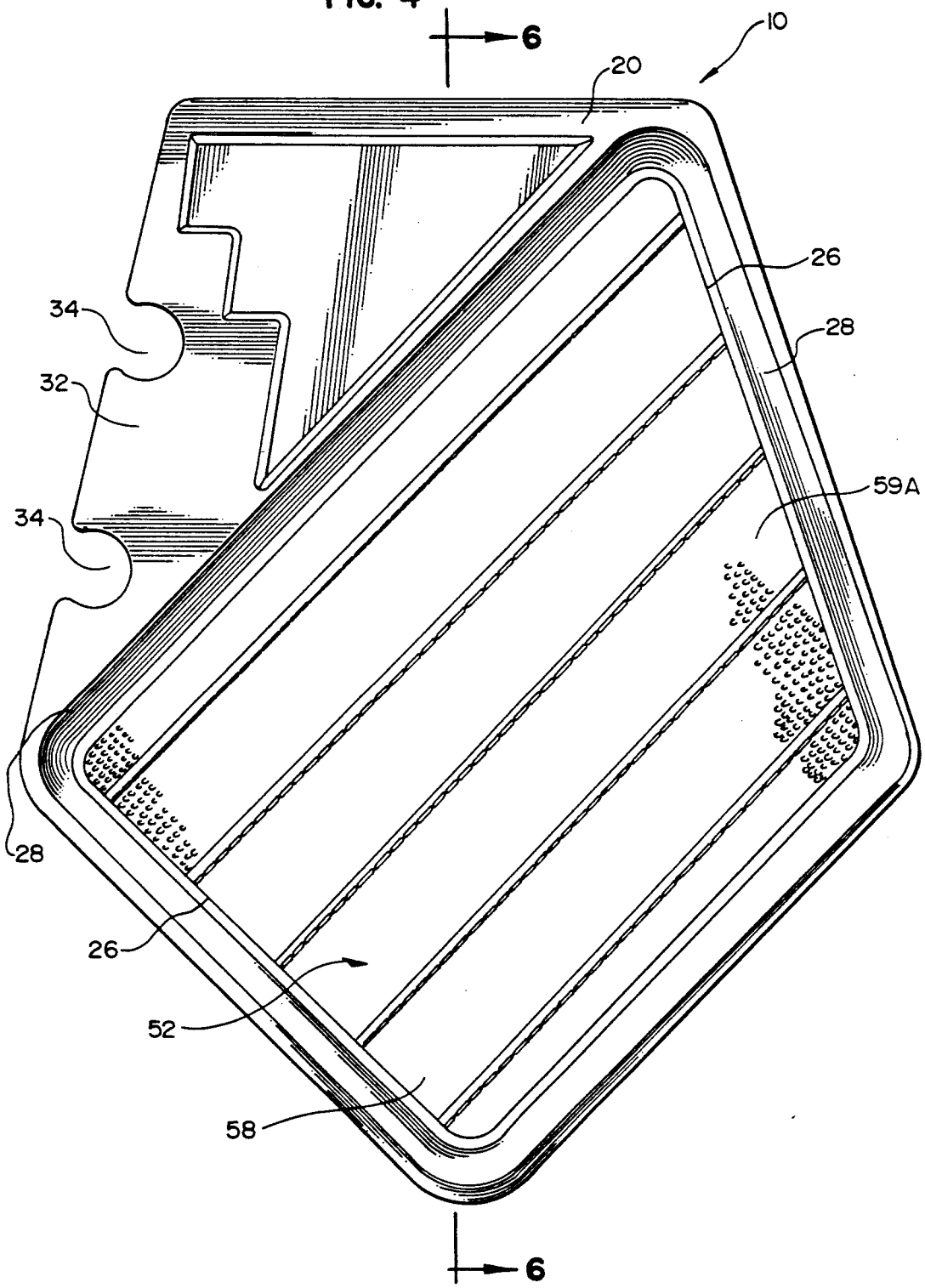
FIG. 4 is a front view of the shield.

Referring to FIG. 4, the shield 10 is preferably formed from any appropriate rigid lightweight plastic, or other material. The shield 10 has a front wall 20 and a rear wall 40. The front wall 20 includes a retainer section 32 and a plurality of inwardly-tapering walls 28 which lead to and circumscribe an inset fastening surface 58 comprising a first part 52 of the two-part fastening system 50. The tapered walls 28 form a perimeter 26 around the inset fastening surface 58. As a result, a dart 12 which strikes a wall 28 tends to slide inwardly along the tapered walls 28 and be captured on the shield 10 instead of merely bouncing off the wall 28. The retainer section 32 and tapered walls 28 are formed integrally with each other and together form the front wall 20.

The retainer section 32 of the front wall 20 forms two circular notches 34 with a section of the circumference removed to allow darts 12 to be placed therein, as shown in FIG. 1. The notches 34 are designed with a diameter smaller than that of the shaft of the dart 12 so that the darts 12 can be removably retained therein. The darts 12 are made from a foam material which allows the shaft to alternately deform and expand when placed in the notches 34 and removed therefrom, respectively, so that the darts 12 are securely retained in the notches 34 when placed therein. This construction allows the players to more easily store and access the darts 12 while playing.

Figure 5:
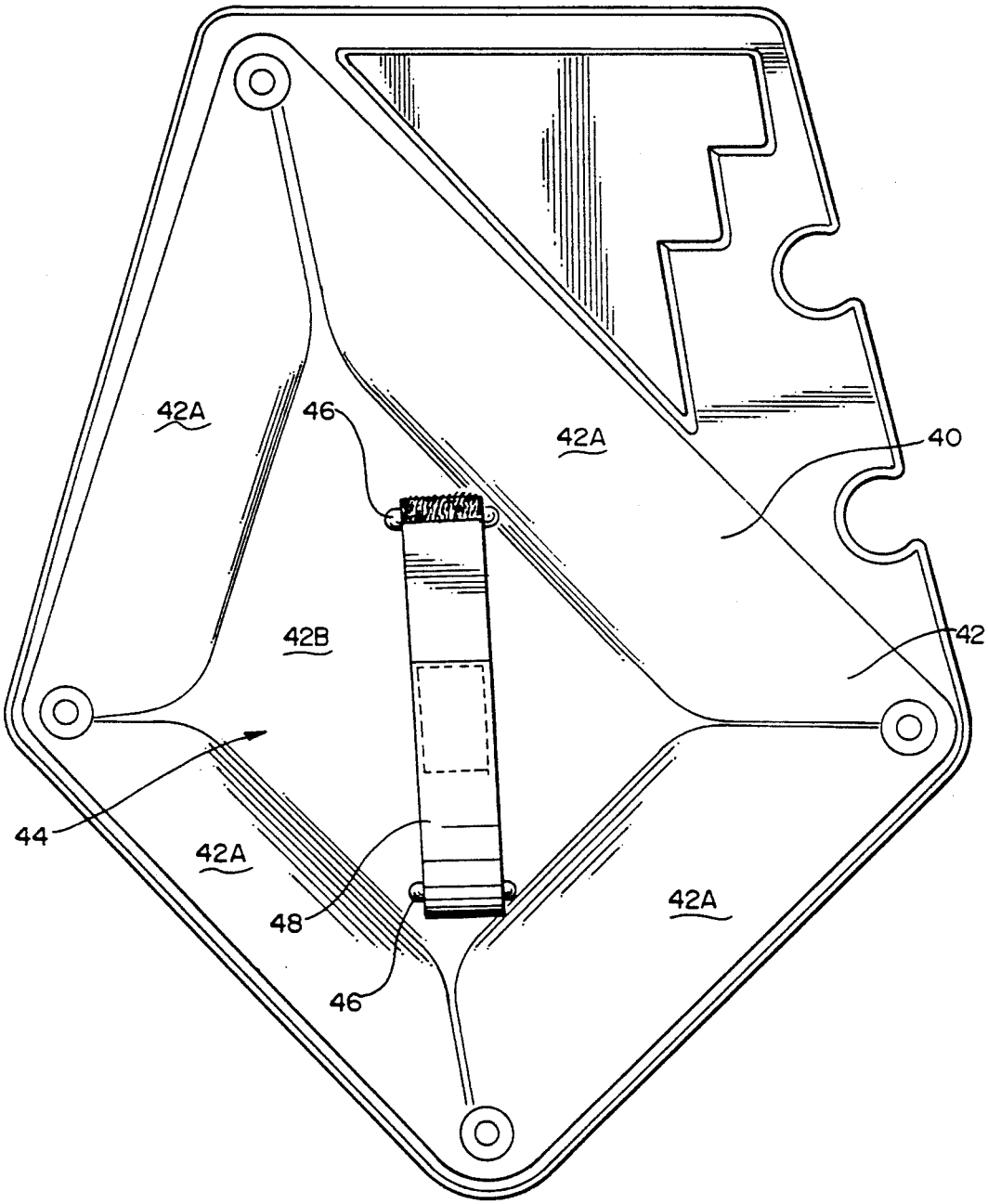
FIG. 5 is a rear view of the shield.

FIG. 5 shows a rear view of the shield 10. The shield 10 has a rear wall 40 formed from a plurality of interconnected planes 42. The planes 42 define a vaulted surface 44. More specifically, the planes 42 can include several inclined planes 42A rearwardly extending from the front wall 20 to join a plane 42B that is rearwardly offset from and parallel to the retainer section 32 of the front wall 20. The rear wall 40, and more specifically, the rearwardly-extending inclined planes 42A are connected to the front wall 20 near the perimeter 26 formed by the tapered walls 24, and preferably to the tapered walls 28.

Figure 6:
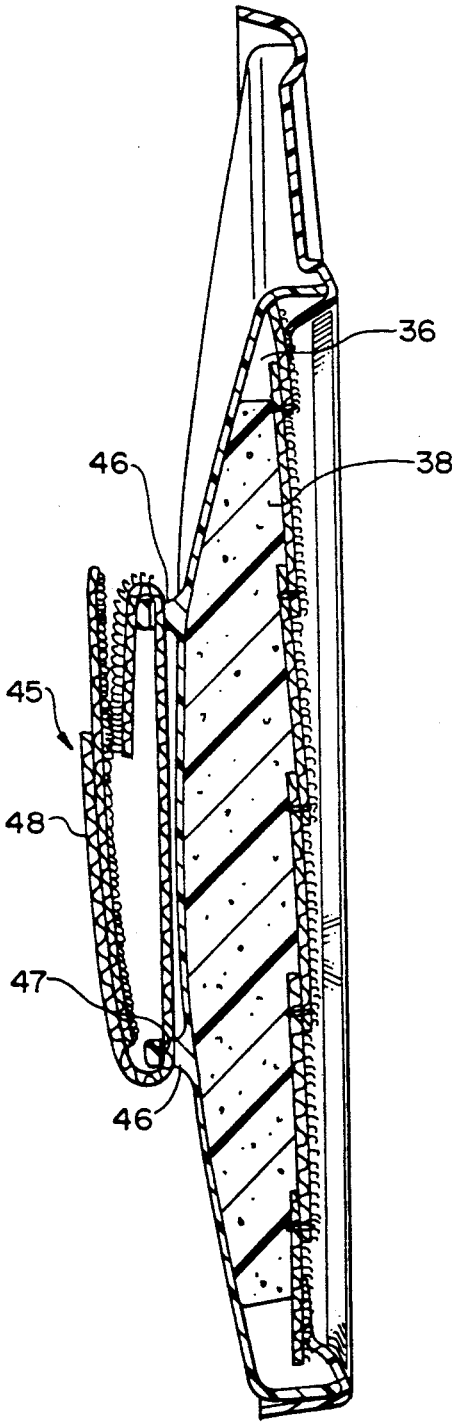
FIG. 6 is a side elevation view, partially in section taken along the line 6—6 in FIG. 4.

Thus, the rear wall 40 forming the vaulted surface 44 connected to the front wall 20 defines a chamber 36, as seen in FIG. 6. The chamber 36 has a foam material 38 therein.

Generally, means 45 for holding the shield 10 are provided on the rear wall 40 to allow the players to control the shields 10. More specifically, the means 45 for holding the shield 10 include a pair of spaced flanges 46 provided preferably integral with the rear wall 40, and more preferably to the plane 42B of the rear wall 40 parallel to the retainer section 32. The spaced flanges 46 are each raised from the surface 44 of the rear wall 40 and form openings 47 between the vaulted surface 44 of the rear wall 40 and the flanges 46. An adjustable strap 48 is fitted through the openings 47. The strap 48 can have a Velcro® attachment thereon allowing the strap 48 to be looped through the openings 47 and adjustably connected to itself.

FIG. 1 shows a player's hand in the strap 48. Likewise, the player can insert his arm through the strap 48 if desired, since the strap 48 is adjustable. When the player's hand is in the strap 48, the vaulted surface 44 formed by the planes 42 allow the players to more easily control and maneuver the shield 10. The players can accordingly support the rear wall 40 of the shield 10 with their fingers on various planes 42 forming the rear wall 40 while the strap 48 evenly supports the shield 10 on the hand's volar surface when the hand is in a relaxed state. Just before a player catches a dart 12, the natural reaction is for the player to tense that hand and, in particular, flex their fingers. The planes 42 forming the vaulted surface 44 in conjunction with the strap 48 allow for this flexure without any slippage of the fingers on the rear wall 40 with consequent loss in control of the shield 10. The finger tips stay in secure contact with the flat, inclined planes 42A while the back of the hand contacts the strap 48. Both the strap 48 and the planes 42 act to effectively bias the back of the hand and the finger tips towards one another so that when catching darts 12 the players maintain a secure grip on the shield 10. The rear wall 40 of shield 10 can be provided with a textured surface for an even more effective finger grip. While it is preferred to provide the rear wall 40 as a separate piece, it is also possible to provide all of the parts of the shield 10, with the exception of the inset fastening surface 58 of the fastening system 50, as an integral piece.

Figure 7:
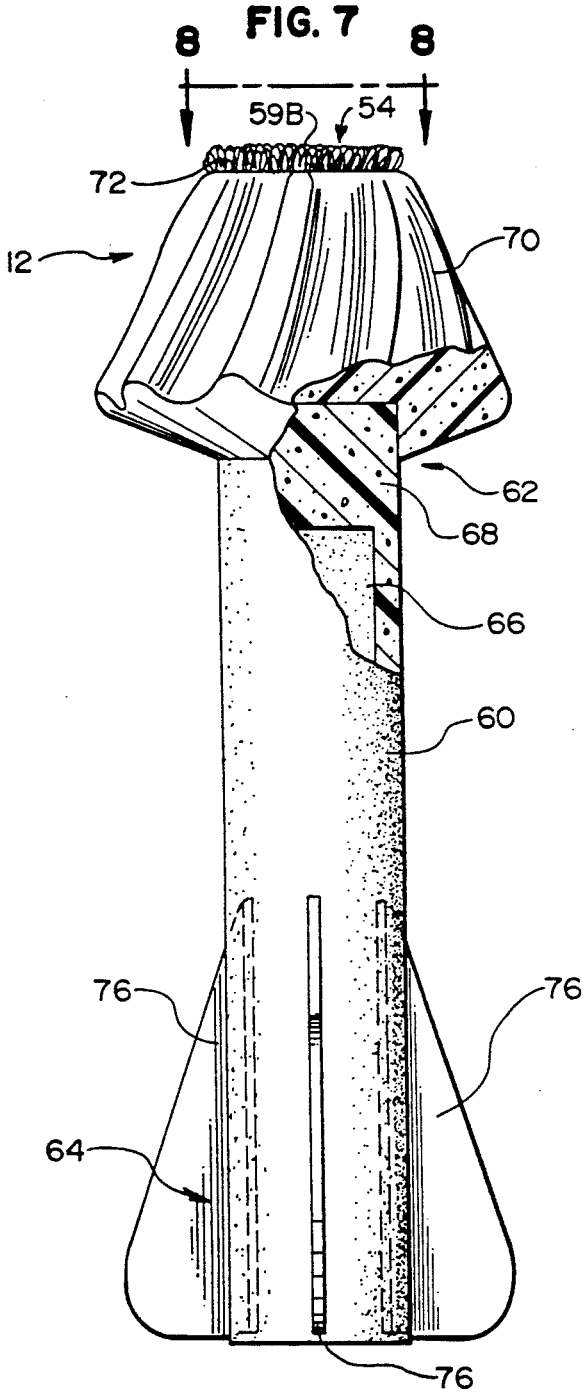
FIG. 7 is a side elevation view of the dart.

The darts 12, as illustrated in FIG. 7, include an elongate shaft 60 having a forward end 62 and a rearward end 64. A front head 70 extends longitudinally from the forward end 62 of the shaft 60 and wings 76 extend generally longitudinally along the rearward end 64 of the shaft 60.

Figure 8:
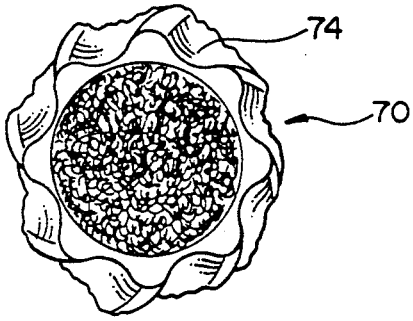
FIG. 8 is a view taken along lines 8—8 in FIG. 7.

The front head 70 is shown in a front view in FIG. 8. The front head 70 is generally frusto-conical in shape having a plurality of longitudinally-extending helical-shaped grooves 74 along the surface thereof. The front head 70 includes an impact surface 72 with part of the fastening system 50 secured thereto, the fastening system 50 being more fully described herein.

The entire dart 12 is preferably made from a lightweight foam material which provides the game with an element of safety, particularly important for young children, and also allows the game to be employed indoors. The head 70 is solid and made from a denser foam material than the rest of the dart 12, thereby being weighted relative to the rest of the dart 12 so no matter how the dart 12 is thrown or where it is gripped (See FIGS. 1-3), the impact surface 72 of the head 70 will lead the rearward end 64 of the shaft 60 during flight so that the impact surface 72 can contact the inset fastening surface 58 of the shield 10 held by another player when thrown towards that player. This gives the players an opportunity to removably capture the darts 12 on the inset fastening surface 58 of their shield 10 and to then remove them therefrom and either store them in the notches 34 provided in the extension part 32 or to throw them at another player providing all ages a more exciting and enjoyable game for players than previously available games involving targets and projectiles.

The elongate shaft 60 can be of a tubular construction having a hollow passageway 66 therethrough. The shaft 60 can be solid 68 at the forward end 62 of the shaft 60 near the head 70 or alternatively a plug can be inserted therein to be securely placed near the head 70 at the forward end 62 of the shaft 60. This further insures that the dart's center of gravity is sufficiently towards the forward end 62 of the shaft 60 so that the previously described flight of the dart 12 occurs when it is thrown towards another player.

The grooves 74 provided in the head 70 assist the dart 12 in its flight by creating aerodynamic forces which tend to assist the dart 12 to fly in a stable, substantially straight and accurate course from one player towards another, indoors or outdoors. Such assistance is further provided by the wings 76 which flare radially outward from the shaft 60 to provide aerodynamic stability and lift to the flight of the dart 12.

A two-part fastening system 50 includes two parts used for fastening the dart 12 to the shield 10, and more particularly, the impact surface 72 of the dart 12 to the inset fastening surface 58 of the shield 10. Preferably, the fastening system 50 is Velcro® hook and loop textile material.

The first part 52 of the fastening system 50 is the inset fastening surface 58 of the shield 10 which comprises a textile piece 59A which is further comprised of a plurality of elongated strips of material sewn together to form a continuous surface, as seen in FIG. 4. The textile piece 59A is flexible and has a surface of pile fabric forming upstanding loops. The textile piece 59A is stretched across the rear wall 40 and connected thereto forming the chamber 36 therebetween.

The second part 54 is a textile covering 59B having outwardly-extending stiff hooks and spines formed of broken loops of filaments and is attached to the impact surface 72 of the dart 12. The broken loops of filaments are designed to hookingly engage the upstanding loops of the textile piece 59A secured to the rear wall 40 of the shield 10.

The flexible textile piece 59A is drawn across the rear wall 40 spanning the area circumscribed by the perimeter 26 formed by the walls 28 so as to be slightly offset inwardly from the retainer section 34 of the shield 10. Due to provision of chamber 36, the textile piece 59A may be deflected inwardly towards the rear wall 40 when a dart 12 strikes the same thereby yielding sufficiently to permit the upstanding loops of the textile piece 59A to engage and retain the broken loops of filament of the textile covering 59B secured to the impact surface 72 of the front head 70 of the dart 12. This reduces the problem of having the dart 12 bounce off the shield 10 when the textile covering 59B of the impact surface 72 of the dart 12 strikes the textile piece 59A of the shield 10.

The foam material 38 provided within the chamber 36 prevents the textile piece 59A from contacting the rear wall 40, and more particularly, the plane 42B of the rear wall 40 parallel to the retainer section 32, when the dart 12 strikes the shield 10. The foam material 38 substantially absorbs the impact of the dart 12 against the textile piece 59A preventing disengagement between the two. The provision of foam material 38 in the chamber 36 further insures that the dart 12 will not bounce off the shield 10 when the textile covering 59B of the impact surface 72 strikes the textile piece 59A of the shield 10.

The foregoing disclosure of specific embodiments is illustrative of the broad inventive concept comprehended by the invention. Various changes in the size, shape and materials, as well as in the details of the illustrated constructions, may be made within the scope of the appended claims without departing from the spirit of the invention.

What is claimed is;

1. A recreational game comprising in combination at least one shield and dart:

the shield having a front wall and a rear wall connected to the front wall, the dart having an elongated lightweight shaft with a forward and a rearward end, an enlarged front head at the forward end of the shaft, the head including a plurality of arcuate-shaped grooves and having an impact surface and being weighted so that the center of gravity of the dart is towards the forward end thereof so that the impact surface leads the rearward end during flight enabling the impact surface to contact the shield; and a two-part fastening system, each part releasable self-fastening connector elements thereon which fasten the two parts when the connector elements contact each other and which release the two parts when the two parts are pulled apart, a first part being circumscribed by the front wall of the shield and the second part being secured to the impact surface of the front head of the dart so that the dart can be captured on the shield when known thereagainst.

2. The recreational game of claim 1 wherein the elongate shaft is of tubular construction having a hollow passageway therethrough.

3. The recreational game of claim 1 wherein the elongate shaft is of tubular construction having a hollow passageway substantially through most of the length thereof.

4. The recreational game of claim 1 wherein the dart includes a plurality of spaced wings providing airfoils located at the rearward end of the elongate shaft of the dart.

5. The recreational game of claim 1 wherein the dart is made from a foam material.

6. The recreational game of claim 1 wherein the second part of the two-part fastening system on the impact surface of the dart includes a textile covering securely attached thereto, the textile covering having outwardly extending stiff hooks and spines formed of broken loops of filament.

7. The recreational game of claim 1 wherein the rear wall comprises a plurality of interconnected planes forming a vaulted surface.

8. The recreational game of claim 1 wherein the first part of the two-part fastening system has a perimeter and the rear wall is connected to the front wall along the perimeter of the first part of the two-part fastening system, the first part and the rear wall forming a chamber therebetween.

9. The recreational game of claim 1 wherein the one part of the two-part fastening system comprises a textile piece having a surface of a pile fabric having upstanding loops.

10. The recreational game of claim 1 wherein the rear wall of the shield includes means for holding the shield.

11. The recreational game of claim 10 wherein the holding means comprises a pair of raised flanges on the rear wall creating an opening between the flanges and the rear wall for receiving an adjustable strap therethrough.

12. A recreational game comprising in combination at least one shield and dart:

the shield having a front wall and a rear wall connected to the front wall, the dart having an elongate shaft with a forward and a rearward end, an enlarged front head at the forward end of the shaft, the head having an impact surface and being weighted so that the impact surface leads the rearward end during flight enabling the impact surface to contact the shield; and a two-part fastening system, each part having releasable self-fastening connector elements thereon which fasten the two parts when the connector elements contact each other and which release the two parts when the two parts are pulled apart, a first part being circumscribed by the front wall of the shield and the second part being secured to the impact surface of the front head of the dart so that the dart can be captured on the shield when known thereagainst;

wherein the first part of the two-part fastening system has a perimeter and the rear wall is connected to the front wall along the perimeter of the first part of the two-part fastening system, the first part and the rear wall forming a chamber therebetween wherein the perimeter circumscribing the first part of the two-part fastening system comprises a plurality of inwardly-tapered walls leading to the first part of the two-part fastening system.

13. The recreational game of claim 12 wherein the first part of the two-part fastening system comprises a textile piece having a surface of a pile fabric having upstanding loops.

14. The recreational game of claim 13 wherein the textile piece is secured to the rear wall and stretches across the rear wall spanning an area defined by the tapered walls such that the textile piece is deflectable inwardly towards the rear wall when struck by a dart so that the connector elements of the two-part fastening system become interlocked to removably retain the dart on the shield.

15. The recreational game of claim 14 wherein the chamber includes a foam material therein.

16. The recreational game of claim 12 wherein the front wall further comprises a retainer selection with notches to removably retain the darts therein.

17. The recreational game of claim 16 wherein the inwardly tapered walls of the front wall, the rear wall and the retainer section of the front wall are integrally formed from a plastic material.

18. A recreational game comprising in combination at least one shield and dart:

the shield having a front wall and a rear wall connected to the front wall, the front face having a retainer section with notches to removably retain the dart therein, the rear wall comprises a plurality of interconnected planes forming a vaulted surface;

the dart having an elongate shaft with a forward and a rearward end, an enlarged front heat at the forward end of the shaft, the head having an impact surface and being weighted so that the impact surface leads the rearward end during flight enabling the impact surface to contact the shield; and a two-part fastening system, each part having releasable self-fastening connector elements thereon which fasten the two parts when the connector elements contact each other and which release the two parts when the two parts are pulled apart, a first part being circumscribed by the front wall of the shield and the second part being secured to the impact surface of the front head of the dart so that the dart can be captured on the shield when thrown thereagainst.

* * * * *